US007828494B1

(12) United States Patent
Reynolds et al.

(10) Patent No.: US 7,828,494 B1
(45) Date of Patent: Nov. 9, 2010

(54) BUOY ASSEMBLY

(75) Inventors: Richard Reynolds, Oshawa (CA); Glenn Murray, Janetville (CA)

(73) Assignee: 6937381 Canada Ltd., Janetville, Ontario (CA)

( * ) Notice: Subject to any disclaimer, the term of this patent is extended or adjusted under 35 U.S.C. 154(b) by 0 days.

(21) Appl. No.: 12/479,032

(22) Filed: Jun. 5, 2009

Related U.S. Application Data

(60) Provisional application No. 61/059,093, filed on Jun. 5, 2008.

(51) Int. Cl.
*E02B 15/06* (2006.01)

(52) U.S. Cl. ..... 405/66; 405/63; 405/64

(58) Field of Classification Search ..... 405/60, 405/63, 64, 65, 66, 70
See application file for complete search history.

(56) References Cited

U.S. PATENT DOCUMENTS

| | | | | | |
|---|---|---|---|---|---|
| 3,344,638 | A | | 10/1967 | Diolot | |
| 3,539,013 | A | | 11/1970 | Smith | |
| 3,618,768 | A | | 11/1971 | Brown | |
| 3,709,357 | A | | 1/1973 | Brown | |
| 3,739,913 | A | | 6/1973 | Bogosian | |
| 3,870,599 | A | | 3/1975 | Azarowicz | |
| 4,102,789 | A | * | 7/1978 | Young | 405/66 |
| 4,116,007 | A | | 9/1978 | Stagemeyer et al. | |
| 4,295,755 | A | * | 10/1981 | Meyers | 405/66 |
| 4,316,804 | A | | 2/1982 | Bocard et al. | |
| 4,480,800 | A | | 11/1984 | Oberg et al. | |
| 4,935,152 | A | | 6/1990 | Gonzales | |
| 5,071,287 | A | * | 12/1991 | Wallace | 405/66 |
| 5,074,709 | A | | 12/1991 | Stensland | |
| 5,160,432 | A | | 11/1992 | Gattuso | |
| 5,186,831 | A | | 2/1993 | DePetris | |
| 5,197,821 | A | * | 3/1993 | Cain et al. | 405/66 |
| 5,284,452 | A | | 2/1994 | Corona | |
| 5,310,283 | A | | 5/1994 | Berg | |
| 5,328,607 | A | * | 7/1994 | Soule | 405/68 |
| 5,334,533 | A | | 8/1994 | Colasito et al. | |
| 5,362,180 | A | * | 11/1994 | Canning et al. | 405/66 |
| 5,451,325 | A | | 9/1995 | Herkenberg | |
| 5,480,261 | A | | 1/1996 | Meyers et al. | |
| 5,580,185 | A | | 12/1996 | Ware | |
| 5,584,604 | A | | 12/1996 | Osterlund | |
| 5,588,889 | A | | 12/1996 | Easter | |
| 5,865,656 | A | | 2/1999 | Sims | |

(Continued)

FOREIGN PATENT DOCUMENTS

| | | |
|---|---|---|
| CA | 2070835 | 5/2000 |

(Continued)

*Primary Examiner*—Frederick L Lagman

(57) ABSTRACT

A buoy assembly for at least partially containing a floating material on a surface of a body of water in a selected area thereon. The buoy assembly includes a roll subassembly with a core element defined by a central axis thereof and a concentric roll of a predetermined length of a barrier material wrapped around the core element, the barrier material extending between a fixed end attached to the core element and a free end thereof, and a body defining a cavity therein, the body including a mounting subassembly for locating the roll subassembly in a predetermined position therein. The body includes an aperture through which a deployed length of the barrier material passes as the deployed length exits the body, the aperture being formed for twisting the deployed length into an at least partially helical configuration.

21 Claims, 16 Drawing Sheets

U.S. PATENT DOCUMENTS

| | | | | |
|---|---|---|---|---|
| 5,885,451 | A | 3/1999 | Porrovecchio, Sr. | |
| 5,906,572 | A | 5/1999 | Holland | |
| 5,948,250 | A | 9/1999 | Middleton | |
| 5,961,823 | A | 10/1999 | Alper | |
| 6,015,501 | A | 1/2000 | Lundback | |
| 6,117,336 | A | 9/2000 | Sachse | |
| 6,383,045 | B1 | 5/2002 | Eckardt | |
| 6,824,853 | B1 | 11/2004 | Levine et al. | |
| 6,880,290 | B2 | 4/2005 | Mahoney | |
| 7,090,432 | B2 * | 8/2006 | Jackson | 405/66 |
| 7,354,516 | B1 | 4/2008 | Young et al. | |
| 2008/0008531 | A1 * | 1/2008 | Jackson | 405/66 |

FOREIGN PATENT DOCUMENTS

| | | |
|---|---|---|
| WO | WO 91/08347 | 6/1991 |

* cited by examiner

BUOY ASSEMBLY

This application claims the benefit of U.S. Provisional Application No. 61/059,093, filed Jun. 5, 2008, the entire contents of which prior application are hereby incorporated herein by reference.

FIELD OF THE INVENTION

This invention is related to a buoy assembly for at least partially containing a floating material on a surface of a body of water in a selected area thereon.

BACKGROUND OF THE INVENTION

A variety of devices and methods for containing oil or other material floating on a body of water are known. For example, when an oil spill does occur, it is usually desirable to limit the size of the oil spill, i.e., to confine the spill to a particular area. It is also desirable to contain the floating material (i.e., the oil spill) as quickly as possible, to minimize damage to the environment.

Once contained, the floating material is cleaned up. For example, in the case of an oil spill, the oil is removed from the water surface for further processing, as is well known in the art.

Relatively bulky booms are often used to contain oil spills, to the extent possible. However, because such booms are relatively thick, they are usually deployed from relatively large reels or rolls. Accordingly, deploying a significant length of a boom may require an expensive and specialized vessel, with a relatively large and specially-trained crew. In summary, given their large size and complexity, using booms to contain an oil spill is relatively expensive, and deployment may take a relatively long time.

On occasion, a prior art boom may be taken out of contact with the surface of the water due to relatively high waves, and oil may escape underneath or above the boom in these circumstances. This occurs because the booms are thick, and somewhat inflexible. Furthermore, the booms become discolored from the oil, making the booms difficult to see from the water or the air. Deploying a second ring of booms around a first ring of booms overcomes the problem of identifying the booms since the second ring is not blackened by the oil. Deploying an outer ring of booms often is not feasible, however, because of the relatively high costs associated with this.

An alternative approach, using "relatively thin flexible sheets of oleophilic, hydrophobic substrates" is disclosed in U.S. Pat. No. 5,451,325 (Herkenberg). The methods of deployment of the flexible substrates disclosed in Herkenberg, however, are limited. For example, Herkenberg discloses protecting a beachfront area by unrolling the flexible substrates from "positioned roll dispensers" appropriately located on land (col. 7, lines 66-68). Herkenberg also indicates that the flexible substrate may be deployed via rolls located in "a small boat or rubber raft" (col. 8, lines 3-7).

The known methods for deployment of the Herkenberg material have a number of disadvantages. For instance, the length of flexible substrate which can be provided is limited to the length of the material on a single roll. Herkenberg does not address how the flexible substrate may be deployed if, for example, a relatively large oil spill is required to be contained. It appears that a relatively large oil spill would require a large reel of the flexible substrate, which would be difficult to handle, and would require time to prepare and deploy. Among other things, a large reel would require a large vessel for deployment therefrom, resulting in significant costs.

SUMMARY OF THE INVENTION

There is therefore a need for a system which addresses or mitigates one or more of the disadvantages of the prior art.

In its broad aspect, the invention provides a buoy assembly for at least partially containing a floating material on a surface of a body of water in a selected area thereon. The buoy assembly includes a roll subassembly having a core element defined by a central axis thereof and a concentric roll of a predetermined length of a barrier material wrapped around the core element, the barrier material extending between a fixed end attached to the core element and a free end thereof, and a body defining a cavity therein. The body includes a mounting subassembly for locating the roll subassembly in a predetermined position therein. In addition, the body includes an aperture through which a deployed length of the barrier material passes as the deployed length exits the body, the aperture being formed for twisting the deployed length into an at least partially helical configuration. Upon deployment of the deployed length on the water surface, the deployed length engages the water surface and extends above the water surface by a predetermined minimum distance for engaging the floating material.

In another aspect, after the body is located on the water surface in a floating position, the body sinks to a predetermined semi-submerged position during deployment of the deployed length.

In another of its aspects, the body sinks from the floating position to the semi-submerged position at a predetermined rate during deployment of the deployed length.

In yet another aspect, when the body is in the semi-submerged position, the deployed length engages the water surface and extends above the water surface by the predetermined minimum distance for engagement with the floating material.

In another aspect, the body is substantially level as it sinks from the floating position to the semi-submerged position.

BRIEF DESCRIPTION OF THE DRAWINGS

The invention will be better understood with reference to the attached drawings, in which.

DETAILED DESCRIPTION

Figure 1A:
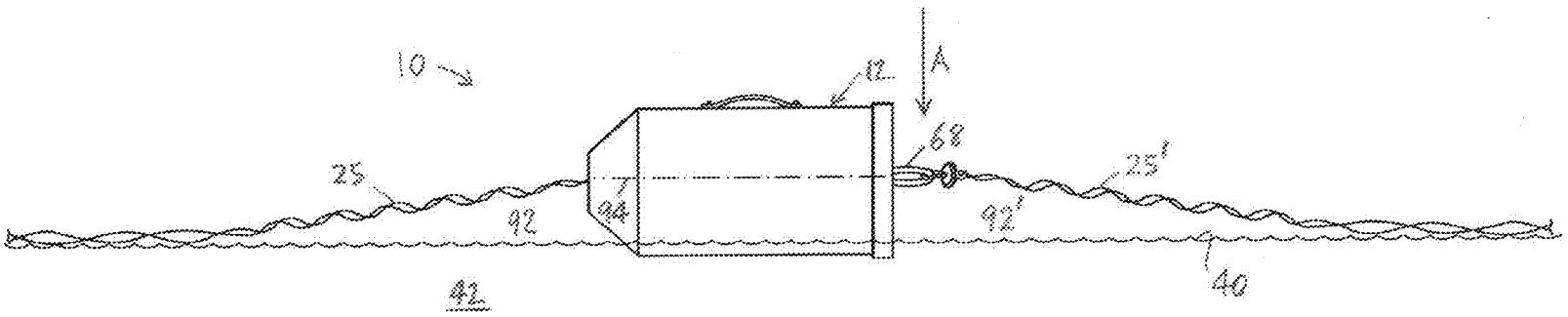
FIG. 1A is a side elevation view of an embodiment of a buoy assembly of the invention in which a body thereof is in a floating position.
Figure 1B:
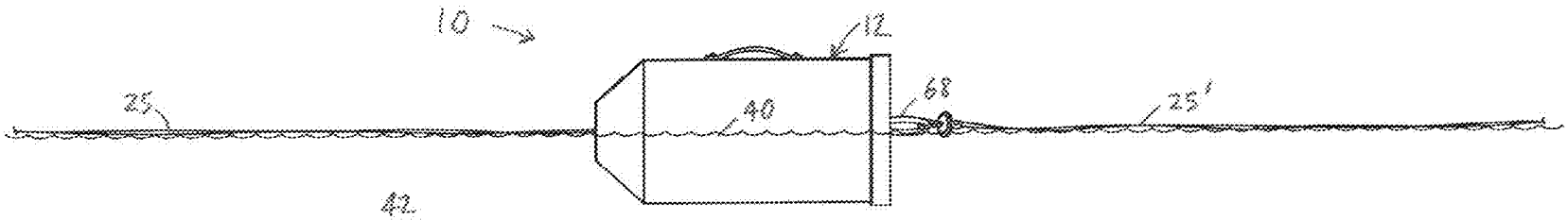
FIG. 1B is a side elevation view of the buoy assembly of FIG. 1A in which the body is in a semi-submerged position.
Figure 1C:
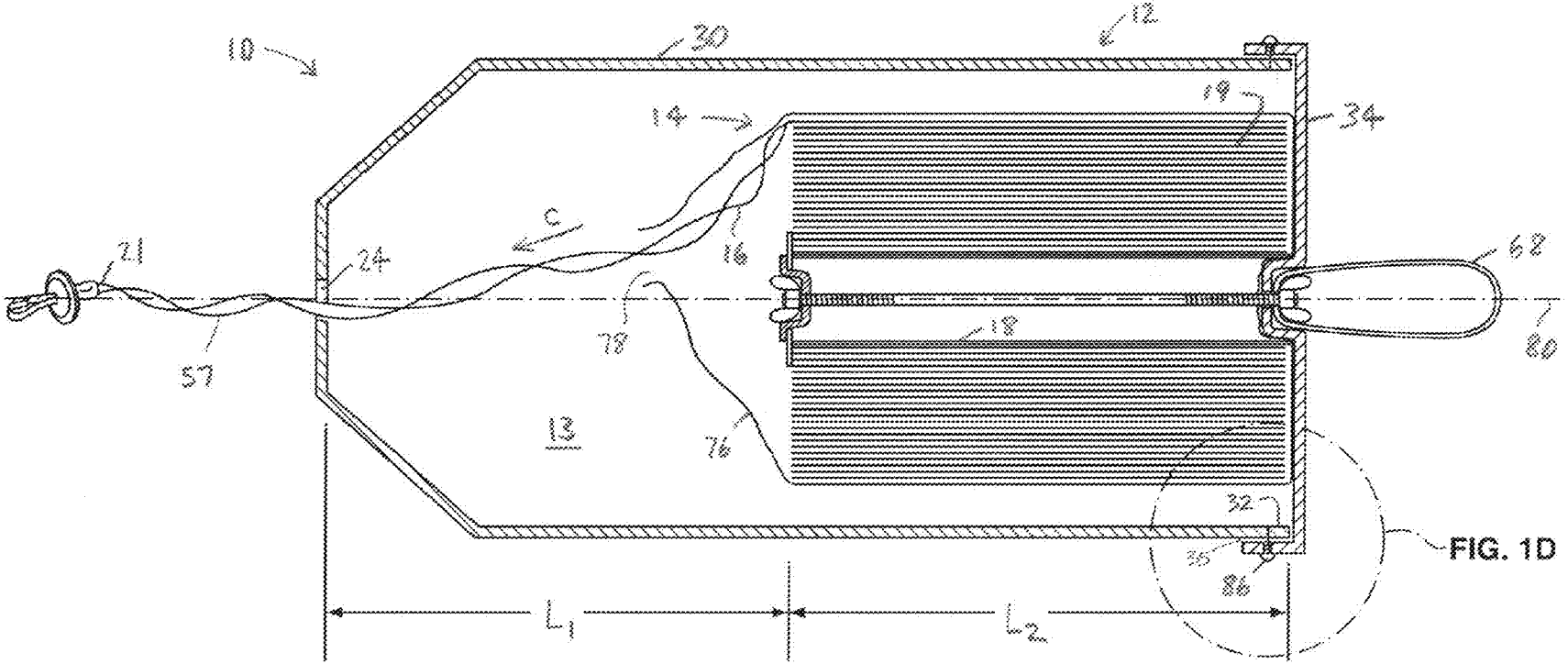
FIG. 1C is a longitudinal cross-section of the buoy assembly of FIG. 1A, drawn at a larger scale.
Figure 1D:
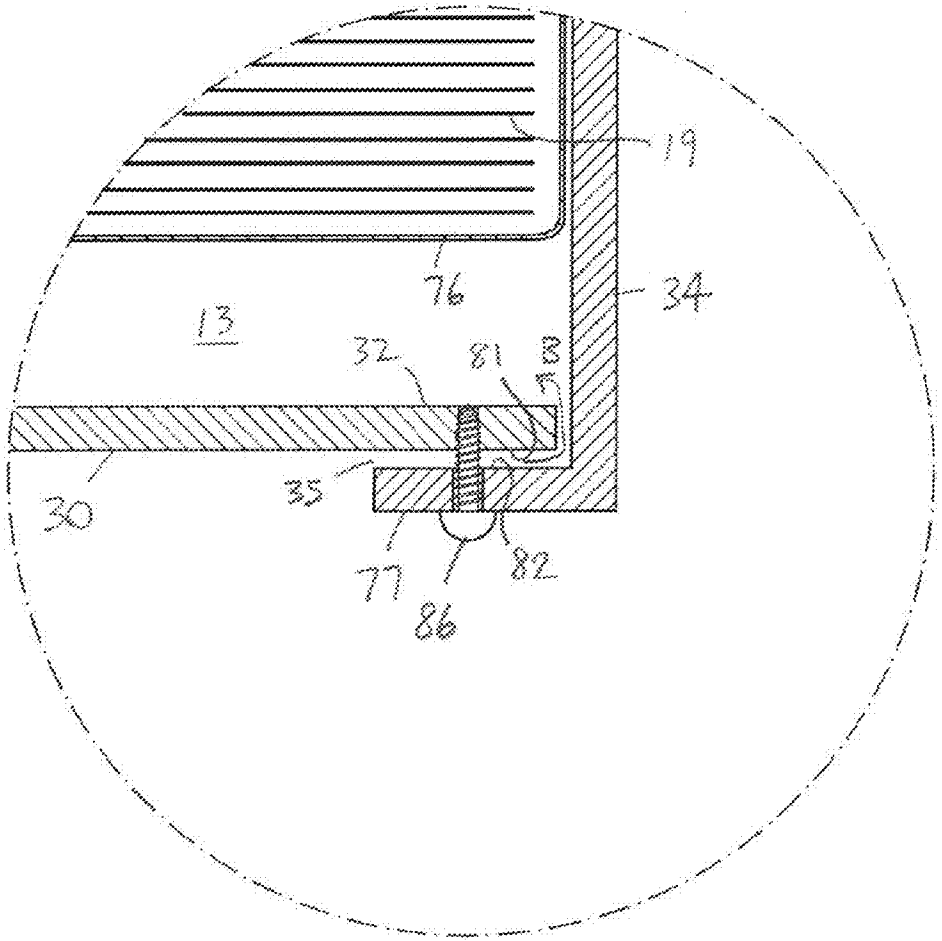
FIG. 1D is a cross-section of a portion of the body of FIG. 1C, drawn at a larger scale.
Figure 1E:
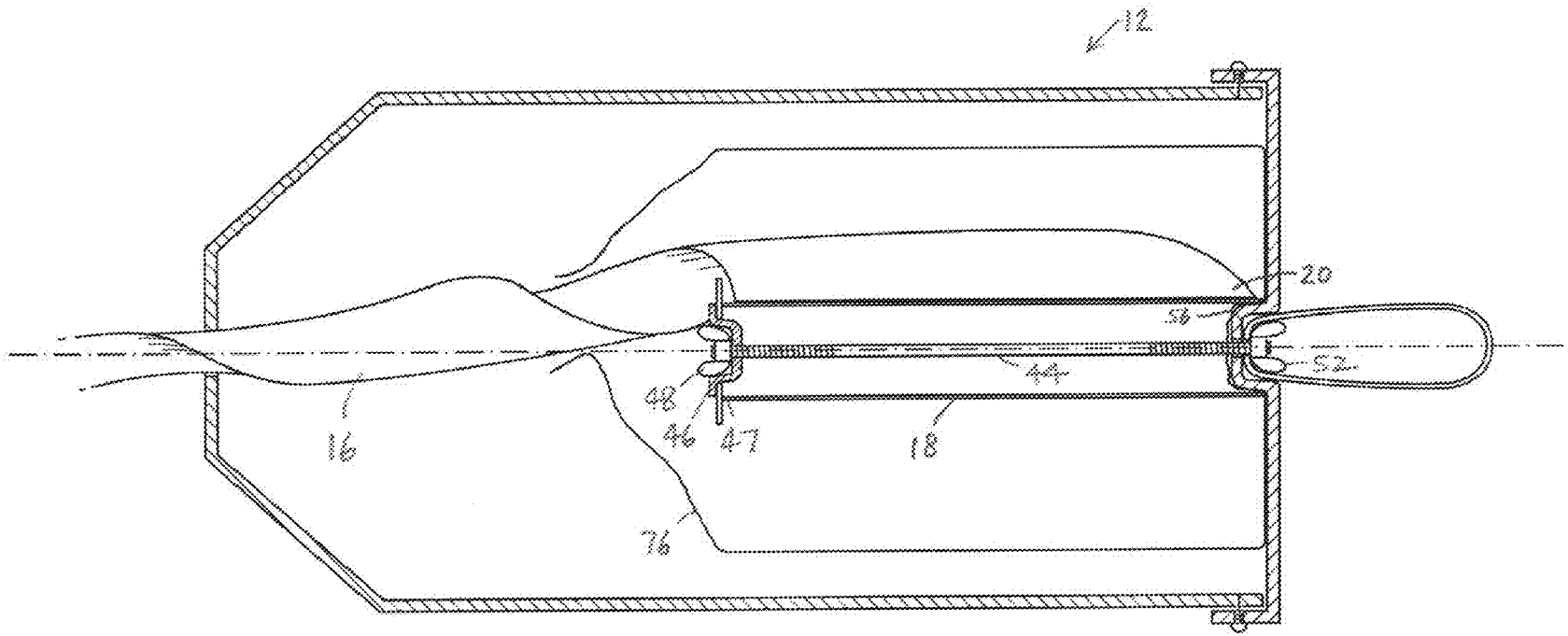
FIG. 1E is a longitudinal cross-section of a portion of the buoy assembly of FIG. 1A with the barrier material deployed, drawn at a smaller scale.
Figure 1F:
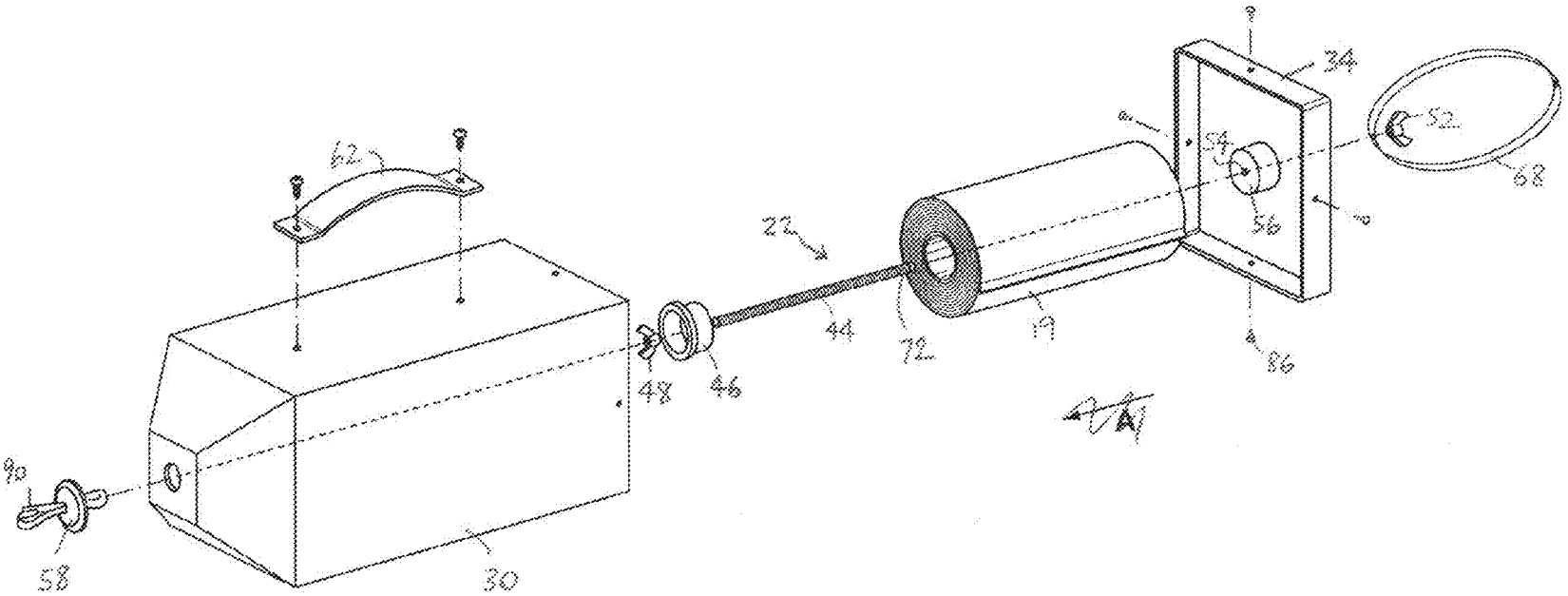
FIG. 1F is an isometric exploded view of the buoy assembly of FIG. 1A, drawn at a smaller scale.
Figure 10:
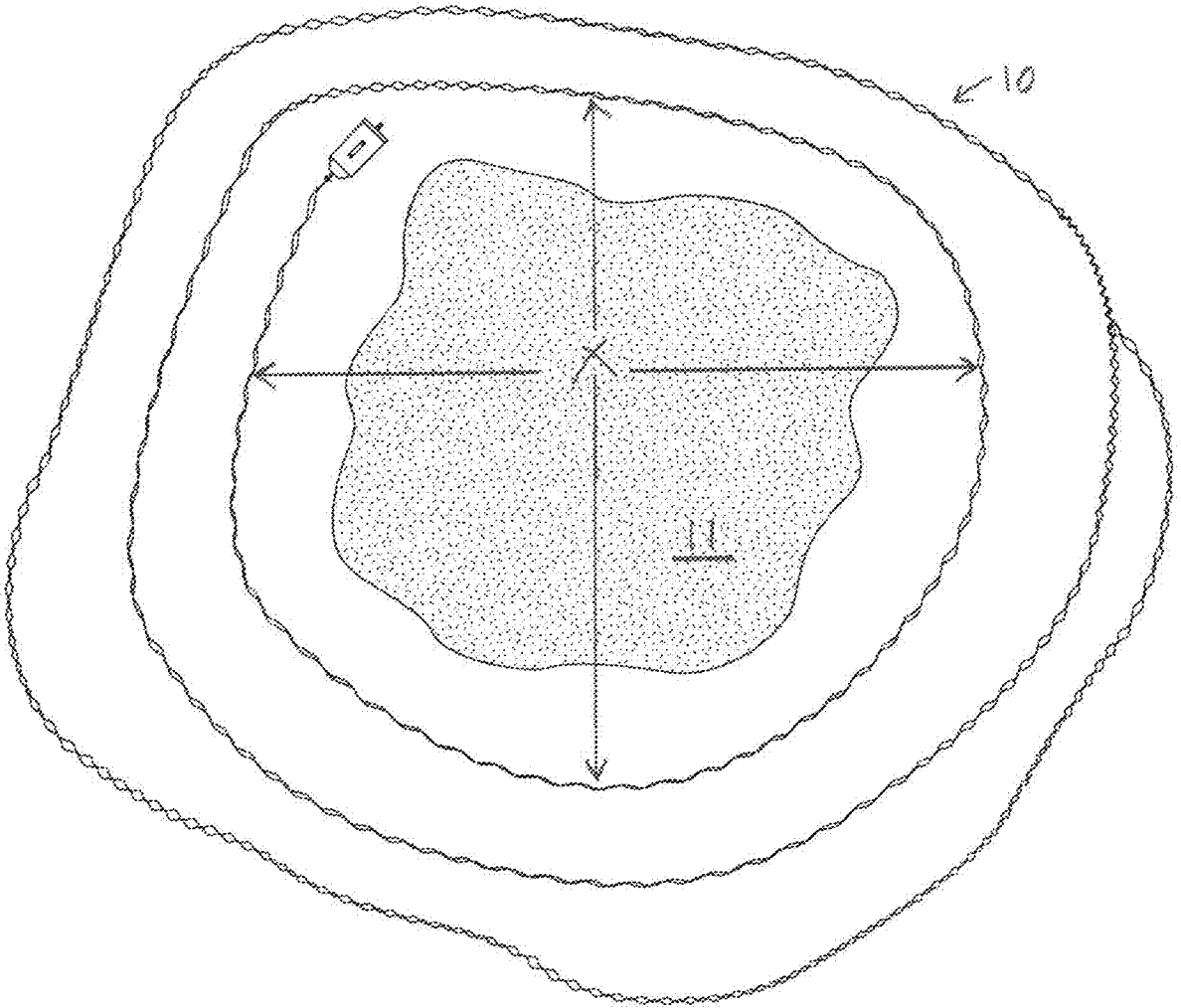
FIG. 10 is a top view of the buoy assembly of FIG. 1A with the deployed length of barrier material positioned around the oil spill.

Reference is first made to FIGS. 1A-1H and 10 to describe an embodiment of a buoy assembly in accordance with the invention indicated generally by the numeral 10. As will be described, the buoy assembly 10 is for at least partially containing a floating material 11 (FIG. 1G) on a surface 40 of a body of water 42 in a selected area thereon (FIG. 10). In one embodiment, the buoy assembly 10 preferably includes a roll subassembly 14 with a core element 18 and a concentric roll 19 of a predetermined length of a barrier material 16 wrapped around the core element 18 (FIG. 1C). The barrier material 16 extends between a fixed end 20 (FIG. 1E) attached to the core element 18 and a free end 21 thereof. Preferably, the buoy assembly 10 also includes a body 12 defining a cavity 13 therein. It is also preferred that the body 12 has a mounting assembly 22 for locating the roll subassembly 14 in a predetermined position therein (FIG. 1F). The body 12 preferably also includes an aperture 24 through which a deployed length 25 of the barrier material 16 passes as the deployed length 25 exits the body 12. Preferably, the aperture 24 is formed for twisting the deployed length 25 into an at least partially helical configuration so that, upon deployment of the deployed length 25 on the water surface 40, the deployed length 25 engages the water surface 40 and extends above the water surface 40 by a predetermined minimum distance "H" (FIGS. 1G, 1H) for engaging the floating material 11, as will be described.

It will be understood that the floating material 11 could be any material floating (whether partially submerged or not) on the water 42, and the water may be fresh or otherwise. The floating material may be, for example, oil. However, those skilled in the art would appreciate that the floating material may be any material floating on a body of water which is undesirable, and the spread of which over the water is to be limited.

The barrier material preferably is any suitable material which is flexible, i.e., sufficiently flexible to be formable into the at least partially helical configuration as the barrier material is drawn through the aperture. Also, the barrier material preferably is sufficiently flexible to ride waves on the water surface, i.e., rather than easily becoming disengaged from the water surface once positioned thereon. However, the barrier material also preferably is sufficiently strong that, once formed into the at least partially helical configuration and positioned on the water surface, the barrier material maintains its shape sufficiently to extend above the water surface by the distance H. This is needed so that the deployed barrier material engages the floating material, to prevent the floating material from drifting past (or over, as the case may be) the deployed barrier material.

If the floating material is oil or any other floating petroleum product, the barrier material preferably is any suitably flexible material which is oleophilic. Preferably, such barrier material is adsorbent, i.e., hydrocarbons tend to coat the barrier material. It is also preferred that the barrier material is hydrophobic.

The oleophilic barrier material preferably is a polyethylene film provided in two film sheets attached at their edges, to define a pocket (or tube) therein along the length of the barrier material. Also, the material preferably includes a number of small holes, spaced apart from each other, through which the oil may enter into the pocket or tube.

Preferably, the barrier material is a relatively thin film or films, as described above. A concentric roll of approximately 1,000 feet is about 11 inches long ($L_2$, in FIG. 1C), and about 6-7 inches in diameter.

In one embodiment, when the roll subassembly 14 is in the predetermined position in the body 12, the aperture is coaxial with the core element (FIG. 1C). Preferably, the core element 18 and the aperture 24 are spaced apart from each other by a predetermined distance "$L_1$" (FIG. 1C) to permit the deployed length to be formed into the at least partially helical configuration as the deployed length passes through the aperture 24.

As shown in FIG. 1A, when the buoy assembly 10 is first placed in the water 42, the body 12 is located in a floating position, in which much of the body 12 is located above the water surface 40. The body is partially submerged when it is in the floating position. After the body 12 is placed in the water (i.e., in the floating position), the body sinks to a predetermined semi-submerged position (FIG. 1B), as will be described. Upon the body 12 being positioned in the water, therefore, the body moves in the direction indicated by arrow "A" in FIG. 1A.

Preferably, the aperture 24 is located at approximately a midpoint 94 of the body 12 (i.e., at approximately one-half the height of the body) (FIG. 1A). While the body is in (or approximately in) the floating position and at least part of the barrier material has been deployed, a gap 92 is defined underneath the deployed barrier material 16 proximal to a front end of the body 12 (FIG. 1A), through which the floating material 11 may move. The gap 92 is therefore undesirable, since the floating material 11 may move in an uncontrolled manner through the gap 92 even if the floating material 11 is completely surrounded by buoy assemblies 10.

In FIGS. 1A and 1B, a deployed length 25' which is part of a trailing buoy assembly is also shown. A fastener element 58' attached to the deployed length 25' connects the deployed length 25' to a connecting element 68 of the buoy assembly 10. As can be seen in FIG. 1A, another gap 92' is also created underneath the deployed length 25' proximal to a back end of the body 12, when the body 12 is in the floating position.

As can be seen in FIG. 1A, therefore, when the body is in the floating position, the floating material can escape containment if the floating material moves through the gaps 92 and 92'.

In order to address this, the body 12 is adapted to sink to the predetermined semi-submerged position in a controlled manner when the buoy assembly 10 is placed in the water 42 as described above, while the deployed length is being deployed. The predetermined semi-submerged position is illustrated in FIG. 1B. As can be seen in FIG. 1B, when the body is in the semi-submerged position, substantially all of the deployed length 25 is in contact with the surface 40. Accordingly, when the body 12 is in the semi-submerged position, the floating material 11 cannot escape underneath the deployed length proximal to the body 12 (i.e., there are no gaps underneath the deployed barrier material proximal to the body).

Figure 1G:
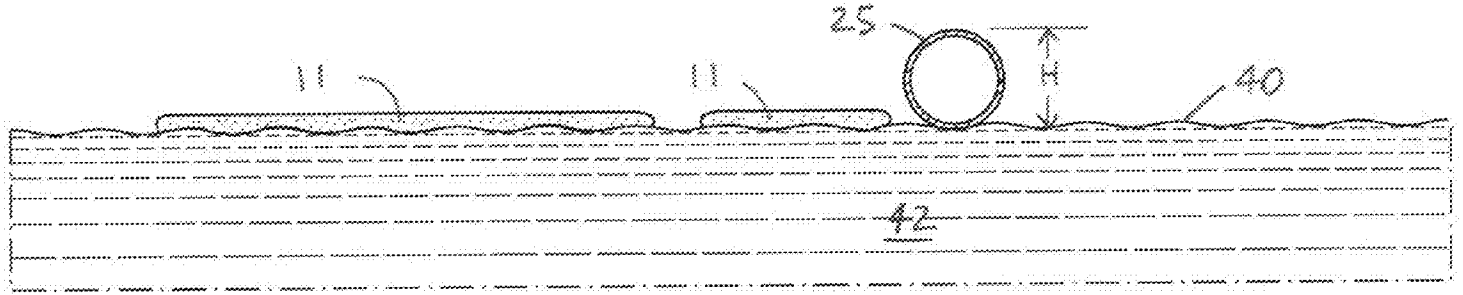
FIG. 1G is a cross-section of a deployed length of barrier material positioned on the water surface, drawn at a larger scale.
Figure 1H:
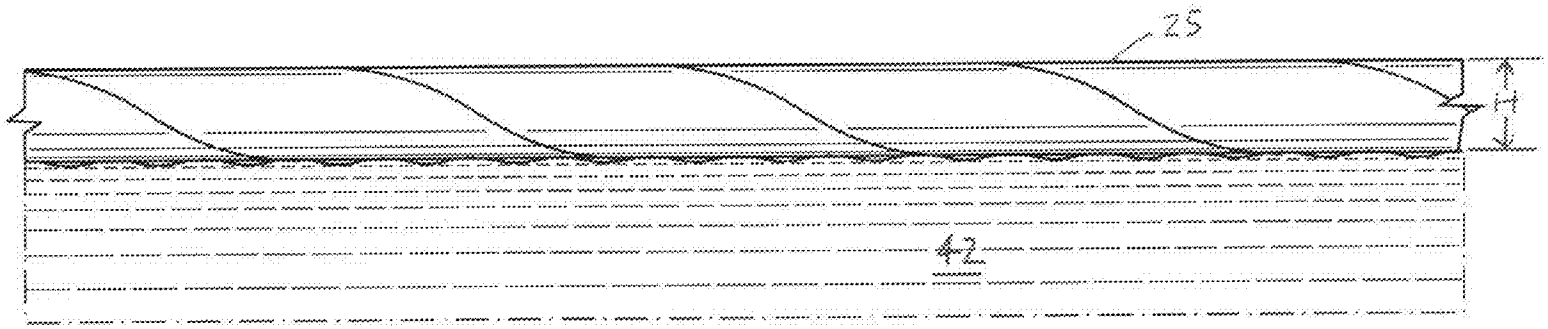
FIG. 1H is side view of the deployed length of barrier material positioned on the water.

In one embodiment, after the body 12 is located on the water surface 40 in floating position (FIG. 1A), the body 12 sinks to a predetermined semi-submerged position (FIG. 1B) during deployment of the deployed length 25. When the body is in the semi-submerged position, it is preferred that about one-half of the body is submerged, as can be seen in FIG. 1B. Preferably, the body 12 sinks from the floating position to the semi-submerged position at a predetermined rate during deployment of the deployed length 25. As can be seen in FIGS. 1B, 1G, and 1H, when the body 12 is in the semi-submerged position, the deployed length 25 engages the water surface 40 and extends above the water surface 40 by the predetermined minimum distance H for engagement with the floating material 11.

The body 12 preferably includes a main portion 30 extending between a front end 31 at which the aperture 24 is located and a back end 32 thereof distal to the front end 31. Preferably, the body 12 also includes an end portion 34 releasably attachable to the back end 32 of the main portion 30. In addition, when the end portion 34 is positioned on the back end 32, the main portion 30 and the end portion 34 define one or more spaces or openings 35 therebetween for allowing water to enter the cavity 13. Preferably, the openings 35 are in communication with the cavity 13. The openings 35 are sized to permit the body 12 to sink at the predetermined rate, as will be described.

Preferably, the predetermined rate is between a minimum rate, defined by a minimum time for the body to sink to the predetermined semi-submerged position, and a maximum rate, defined by a maximum time for the body to sink to the predetermined semi-submerged position.

In one embodiment, the end portion 34 includes an engagement part 77 adapted to fit around the back end 32 of the main portion 30. As can be seen in FIG. 1D, the opening 35 is defined by an outer surface 81 of the main portion 30 and an inner surface 82 of the engagement part 77. Preferably, when the end portion 34 is attached to the back end 32 of the main portion 30, the inner and outer surfaces 82, 81 are substantially parallel to each other, and the opening 35 therebetween is sufficient to permit water to flow in the direction indicated by arrow "B" into the cavity 13. Various means for releasably attaching the end portion 34 to the main portion 30 will occur to those skilled in the art. In one embodiment, the end portion 34 is releasably attached to the back end 32 of the main portion 30 by removable fasteners 86 driven through the engagement part 77 into the main portion 30.

As can be seen in FIG. 1B, when the body 12 is in the semi-submerged position, the aperture 24 is substantially at the water surface 40. When the body 12 is in this position, any further deployment of the barrier material 16 from the body 12 is difficult, due to drag (i.e., friction) between the deployed barrier material and the water. Accordingly, it is preferred that the body 12 remain at least partially floating, i.e., above the semi-submerged position to at least an extent, while the barrier material is being deployed from the body 12.

The main portion and the end portion of the body 12 preferably are made of any suitable material and formed so as to sink in a controlled manner to the semi-submerged position. For example, low-density linear polyethylene has been found to be a suitable material for the main portion and the end portion. Other suitable materials will occur to those skilled in the art. Also, the openings 35 are formed to provide for the body sinking to the semi-submerged position at the predetermined rate, as described above.

It has also been found that the amount of barrier material 16 that has been deployed from the body 12 affects the rate at which the body 12 sinks to the semi-submerged position. For example, if virtually the entire length of the barrier material is deployed, then the weight of the roll remaining in the body 12 after deployment is relatively small, and a relatively long time is required for the body 12 to sink to the semi-submerged position. In these circumstances, the body 12 may sink from the floating position to the semi-submerged position over about ten minutes. This permits the deployed length to be deployed before the body 12 is in the semi-submerged condition.

However, if the deployed length is relatively short, then the body has a somewhat larger roll remaining in it once deployment is completed, and the body sinks more rapidly. For instance, the body 12 may sink to the semi-submerged position in about five minutes or less.

From the foregoing, it can be seen that the body 12 sinks to the semi-submerged position more quickly when a shorter length of the barrier material is deployed. Conversely, when a longer length of the barrier material is deployed, a correspondingly longer time is required for the body to sink to the semi-submerged position. The advantage of this feature is that a longer time for sinking is required when a longer length of the barrier material is deployed.

Preferably, the body is substantially level as it sinks from the floating position to the semi-submerged position. It will be appreciated by those skilled in the art that the body 12 preferably is self-levelling because of the desirability of eliminating gaps (e.g., the gaps 92 and 92' shown in FIG. 1A) underneath the deployed barrier material (between the deployed barrier material and the water surface) and proximal to the body 12. Such gaps may develop or be exacerbated during settlement of the body (i.e., during sinking from the floating position to the semi-submerged position) if the body does not remain level, or at least approximately level, as it sinks to the semi-submerged position. In addition, once in the semi-submerged condition, the body is positioned substantially level so that there are no gaps underneath the barrier material proximal to the body.

The body is self-levelling as it sinks, in part, because the openings 35 are formed and positioned to result in a substantially symmetrical inflow of water into the cavity 13 at the back end 32 while the body is sinking. Also, once water has flowed through the openings 35, it flows rapidly into the cavity 13, where it causes the body to remain level as the amount of water in the cavity 13 increases. The openings 35 have substantially the same size, and are positioned substantially symmetrically relative to the longitudinal axis 80. Because of this, the inflow of water at the back end 32 of the main portion 30 is substantially symmetrical relative to the longitudinal axis.

It is preferred that the mounting subassembly 22 includes a mounting part 56 for locating the roll subassembly 14 in the predetermined position inside the body 12. Preferably, the mounting subassembly 22 includes a threaded rod 44 attached to an inner side 45 of the end portion 34 for securing the roll subassembly 14 in the predetermined position.

The buoy assembly 10 is shown in an exploded view in FIG. 1F. In one embodiment, the mounting assembly 22 preferably includes a rod 44, a front cap 46 and two nuts 48, 52 for holding the rod 44 in place relative to the end portion 34 of the body 12. Preferably, the rod 44 is threaded at each of its ends and is adapted to be received in an aperture 54 located on the mounting part 56 in the end portion 34.

As can be seen in FIGS. 1C and 1F, when the buoy assembly 10 is assembled, the core element 18 fits onto the mounting part 56. The rod 44 is positionable through the aperture 54 either before or after the roll is positioned on the mounting part 56. Once the core element 18 is in position on the mounting part 56 and the rod 44 is coaxial therewith, the rod 44 is fastened in place to the end portion 34 by the fasteners 48, 52 (preferably, wing nuts). As can be seen in FIGS. 1E and 1F, the front cap 46 is positioned on a front end 47 of the core element 18 before the nut 48 is threadably attached to the rod 44, so that the nut 48 holds the core element 18 in position via the front cap 46. From the foregoing, it can be seen that the core element 18 preferably does not rotate as the barrier material 16 is deployed.

It also can be seen from the foregoing that, to secure the roll subassembly 14 in the predetermined position in the body 12, the roll subassembly 14 is first attached (i.e., as described above) to the end portion 34. After the roll subassembly 14 has been so attached, the end portion 34 is attached to the back end 32 of the main portion 30, as described above.

It will be appreciated by those skilled in the art that a part 57 of the barrier material 16 preferably is drawn through the aperture 24 after the roll subassembly 14 is attached to the end portion 34, but before the end portion 34 is attached to the main portion 30 (FIG. 1C).

The roll subassembly 14 preferably additionally includes a bag portion 76 for limiting contact of the barrier material 16 in the roll 19 with water (FIG. 1C). (For clarity of illustration, the bag portion 76 is omitted from FIG. 1F.) The bag portion 76 substantially surrounds the roll 19. As shown in FIG. 1C, the bag portion 76 includes an opening 78 through which the barrier material 16 may be pulled for deployment (FIG. 1C).

As will be discussed, the roll subassembly 14 is intended to be discarded after use. In practice, therefore, a number of roll subassemblies are stored pending use. Because the barrier material 16 preferably is a relatively thin film, the barrier material 16 may be subject to degradation, if subjected to prolonged exposure to ultraviolet radiation. The bag 76 minimizes damage to the barrier material 16 while the roll subassembly is in storage, i.e., prior to use in the body 12. The bag has the additional benefits of preventing accidental deployment of the barrier material prior to positioning the roll subassembly 14 in the body 12, and also providing a seal between the rod 44 and the aperture 54.

As can be seen in FIG. 1F, the connecting element is held in place against an outer side 87 of the back portion 32 by the nut 52, which is threadably engaged with the rod 44 at the back end 72 thereof. In addition, the rod 44 preferably is driven through the bag 76 (not shown in FIG. 1F) when the roll subassembly is positioned on the mounting subassembly. When this is done, the rod 44 (being secured to the end portion by the nut 52) is pushed through the bag 76 and then through the core element 18 until the front cap 46 can be positioned on the rod 44. As described above, once the front cap 46 is so positioned, the nut 48 is threadably engaged with the rod 44, and tightened to hold the core element 18 tightly against the mounting part 56 (FIGS. 1C, 1E). As can be seen in FIGS. 1C and 1E, once the roll subassembly 14 is secured by the mounting subassembly 22, the bag 76 preferably is at least partially positioned between the rod 44 and the aperture 54, where it at least partially obstructs inflow of water through the aperture 54 when the body is in the semi-submerged position.

Preferably, the roll subassembly 14 includes a fastener element 58 attached to the free end 21 of the barrier material 16. The fastener element 58 is for connecting the free end 21 of the barrier material to an object. In one embodiment, the body 12 additionally includes a connecting element 68 adapted for releasable connection with the fastener element 58 so that the free end 21 is thereby connectable to the body 12 to position the deployed length 25 in a preselected location relative to the selected area. As will be described, the fastener element 58 may be connected to other objects, as desired.

The free end 21 and the fastener element 58 may be attached together using any suitable means, such as using an adhesive, by piercing the free end 21 with the fastener element 58, or by heat sealing the barrier material 16 with the fastener element 58. As shown in FIG. 1C, the fastener element 58 may be used to pull the barrier material 16 out of the body 12 for deployment of the barrier material 26 on the surface 40. The fastener element 58 may include a clasp 90 that is adapted to fasten or clip onto the connecting element 68 of another buoy assembly 10, as described below.

The connecting element 68 preferably is a loop or hitch of material such as plastic, metal or any other suitable material. The connecting element 68 preferably is affixed to the end portion 34 using a nut 52 that engages the end 72 of the rod 44 (FIG. 1F). However, those skilled in the art would be aware that the connecting element 68 may be attached to the body in a variety of locations on the body, using a variety of means for attachment.

As can be seen in FIG. 1C, when the roll subassembly 14 is in the predetermined position inside the body 12, the roll subassembly 14 preferably is spaced apart from the aperture 24 by a distance "$L_1$". The distance $L_1$ preferably is sufficient to permit the deployed length 25 of the barrier material 16 to be at least partially formed into the helical configuration. It has been determined that the helical configuration is at least partially formed when $L_1$ is approximately one-half of the length of the body. In FIG. 1D, the roll has a length "$L_2$" which is approximately equal to $L_1$.

As mentioned above, the buoy assembly 10 includes an aperture 24 positioned through the front portion 32 of the body 12. The aperture 24 preferably is substantially coaxial with a longitudinal axis 80 of the core element 18 (FIG. 1C), so that the barrier material 16 is formed into the at least partially helical configuration as it is pulled through the aperture 24, in the direction indicated by arrow "C" in FIG. 1C.

As an example, where the barrier material is approximately 10 inches in width (i.e., when laid flat), the aperture with a diameter of approximately 1 inch has been found to provide satisfactory results. The aperture with a diameter of approximately 1 inch allows the diameter of the helix formed to also be approximately 1 inch. Deploying the barrier material 16 in a twisted form provides several advantages. When at least partially formed into a helix, the deployed barrier material 16 is easier to handle, i.e. easier to deploy in a selected location, and easier to handle when retrieved. For instance, the twisted formation tends to allow the barrier material 16 to be deployed without getting caught by the wind. Furthermore, the barrier material 16 can be stored in a relatively thin form (i.e., flat on the core element 18, in the roll), until deployment. However, when deployed in an approximate helix form, the deployed barrier material forms a "boom" with a diameter of approximately 1 inch to catch floating material, stopping further spread of the floating material. In effect, a relatively long length of a three-dimensional "boom" is stored in a relatively small space (i.e., inside the body) in a flattened configuration in the roll until deployed.

The body 12 preferably also includes a handle 62 positioned on a side surface 60 of the body 12. The handle 62 is intended to provide a loop onto which an operator (not shown) may hook, to retrieve the buoy assembly 10 from the water. The handle is also useful in handling the body in other situations, e.g., when placing the buoy assembly 10 in the water, or when moving and storing the buoy assembly 10. It will be appreciated that the handle 62 may be attached to the surface 60 by any suitable means, for example, with fasteners 66.

As can be seen in FIG. 10, the deployed length 25 is positionable around the selected area X several times in a generally spiral path, to minimize the possibility of the floating material escaping from the selected area X. The deployed length 25 may be located around the selected area X as shown in FIG. 10, for example, where weather and wave conditions are such that containment of the floating material with only a single strand of the barrier material may not be feasible. In FIG. 10, the fastener element 58 is shown connected to the deployed length 25 at a selected point.

As shown in FIG. 10, the buoy assembly 10 may be used without connecting the fastener element 58 to another object. It will be understood that the fastener element 58 may alternatively be connected to the connecting element 68 of the same buoy assembly, or to the connecting element on another buoy assembly (i.e., when the buoy assemblies are connected in series), depending on the size and configuration of the selected area X.

When the floating material (e.g., oil) has been cleaned up (i.e., generally removed from the water surface in the selected area X, the buoy assembly 10 is removed. If the floating material engaged by the deployed length 25 was oil, then the deployed length is covered with oil, and barrier material preferably is disposed of. The body 12 preferably is cleaned. A new roll subassembly is positioned in the body, in the predetermined position, after which the newly constituted buoy assembly may be used.

From the foregoing, it can be seen that the buoy assembly of the invention is relatively compact and inexpensive, as well as being rapidly deployable.

Additional embodiments of the invention are shown in FIGS. 2-9B. In FIGS. 2-9B, elements are numbered so as to correspond to like elements shown in FIGS. 1A-1H and 10.

Figure 2:
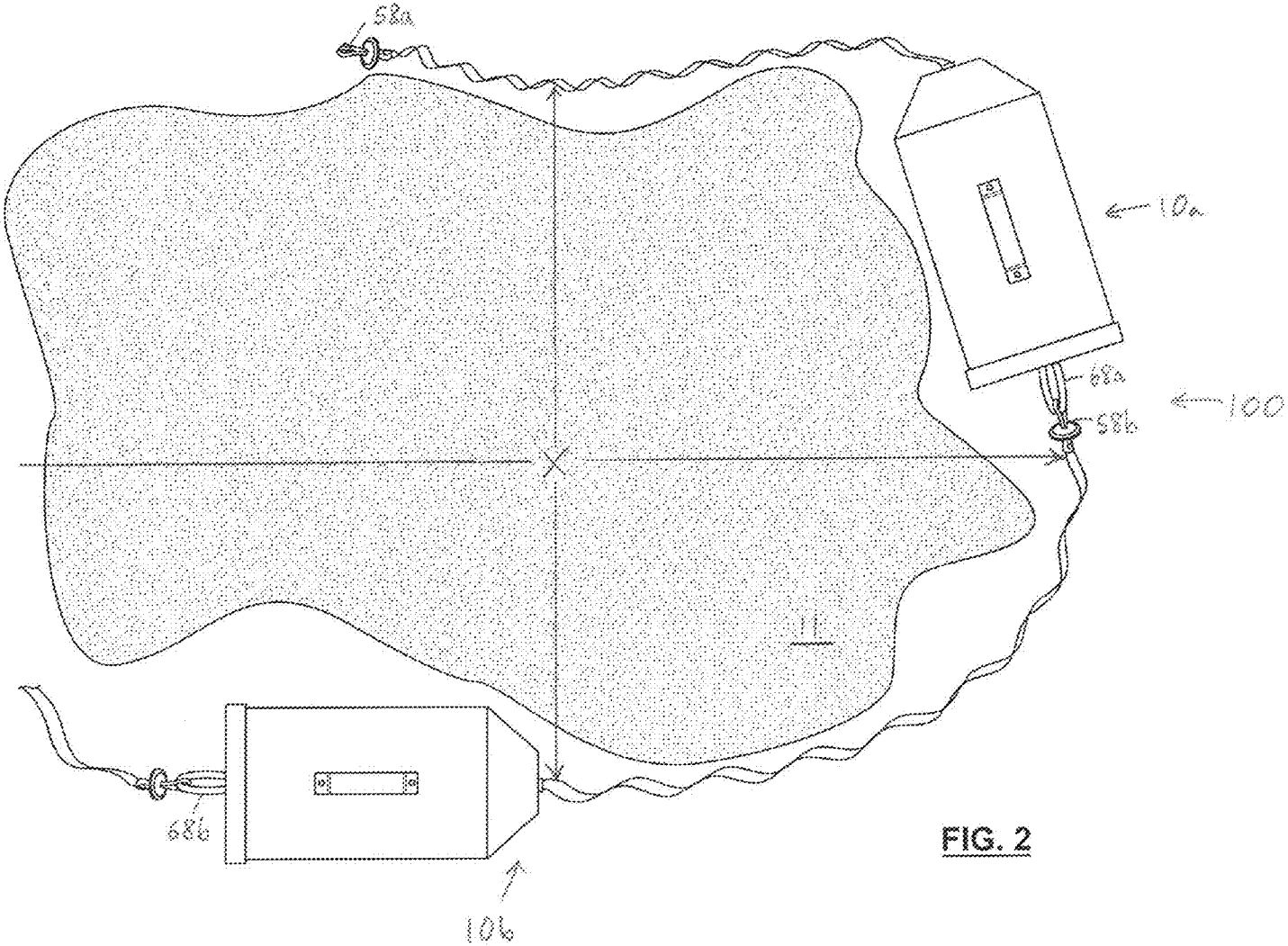
FIG. 2 is a top view of two buoy assemblies of FIG. 1A, connected in series around a selected area on the water surface in which a floating material is located, drawn at a smaller scale.
Figure 3:
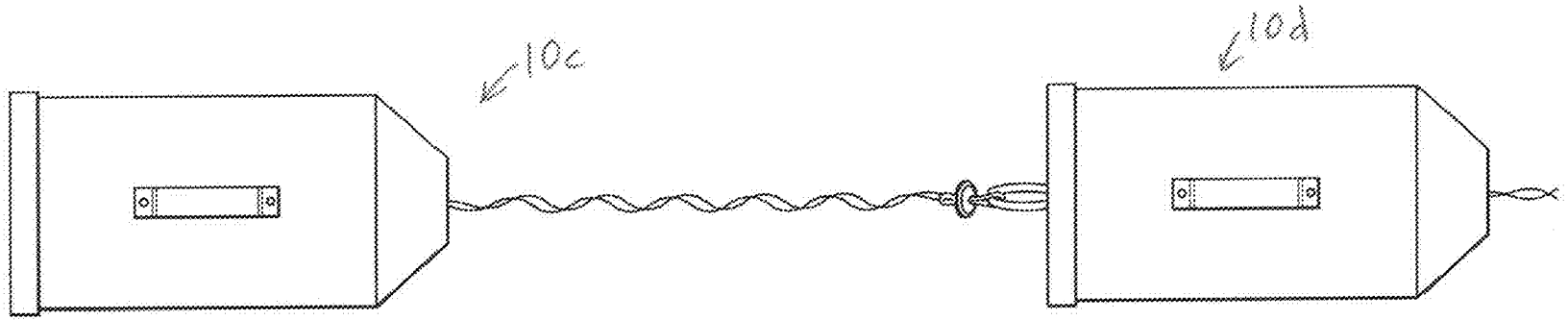
FIG. 3 is a top view of two buoy assemblies of FIG. 1A connected in series, drawn at a larger scale.

Reference is next made to FIGS. 2 and 3 to describe an embodiment of a system 100 of the invention for at least partially containing the floating material on the surface of a body of water in the selected area X thereon. The system 100 preferably includes a number of buoy assemblies 10.

For example, in FIG. 2, two buoy assemblies (identified for convenience as 10*a* and 10*b*) are connected in series. The fastener element 58*b* of buoy assembly 10*b* is connected to the connecting element 68*a* of buoy assembly 10*a*. (It will be understood that the fastener element 58*a* of buoy assembly 10*a* is connected to another buoy assembly which is not shown in FIG. 2, and also the fastener element of another buoy assembly attached to the connecting element 68*b* is not shown, to simplify the illustration.) As can be seen in FIG. 2, in one embodiment, the selected area X is somewhat larger than the area covered by the floating material, when the buoy assemblies are distributed on the water surface. The buoy assemblies are distributed in predetermined locations relative to the selected area X in which the floating material 11 is to be contained. In FIG. 2, the predetermined locations are approximately at the perimeter of the selected area X. However, as will be described, the buoy assemblies may be distributed in a variety of predetermined locations relative to the preselected area X.

Figure 8A:
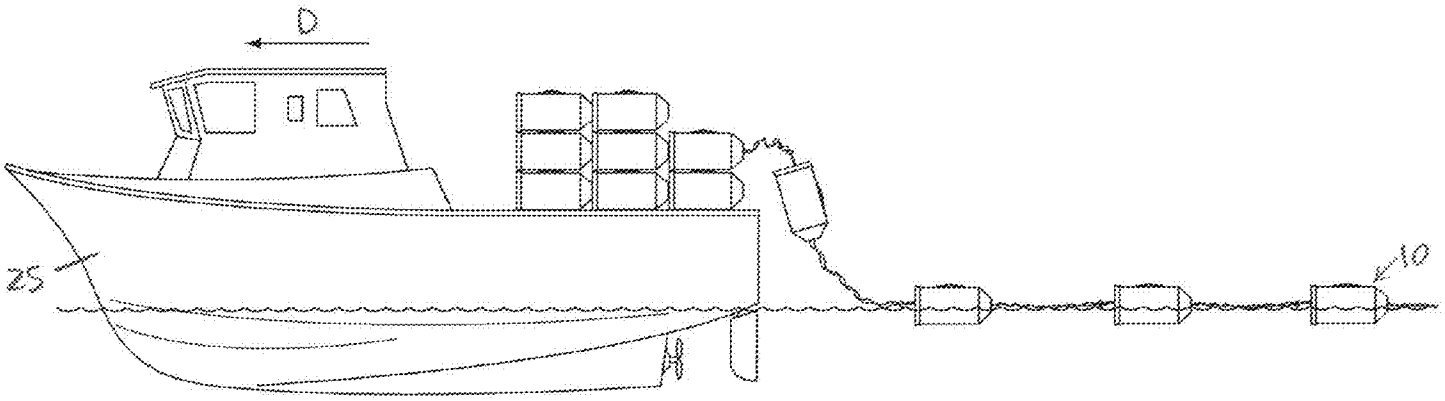
FIG. 8A is a side view illustrating an embodiment of a method of distributing buoy assemblies of the invention in series, drawn at a larger scale.

One method of distributing the buoy assemblies in the system 100 is shown in FIG. 8A. The buoy assemblies are connected to each other in series and positioned in a vehicle 25 (e.g., a vessel). As the vehicle moves forward (i.e., in the direction indicated by arrow "D" in FIG. 8A), the buoy assemblies are pulled from the vehicle into the water one at a time, as they are distributed to the predetermined locations therefor.

Figure 8B:
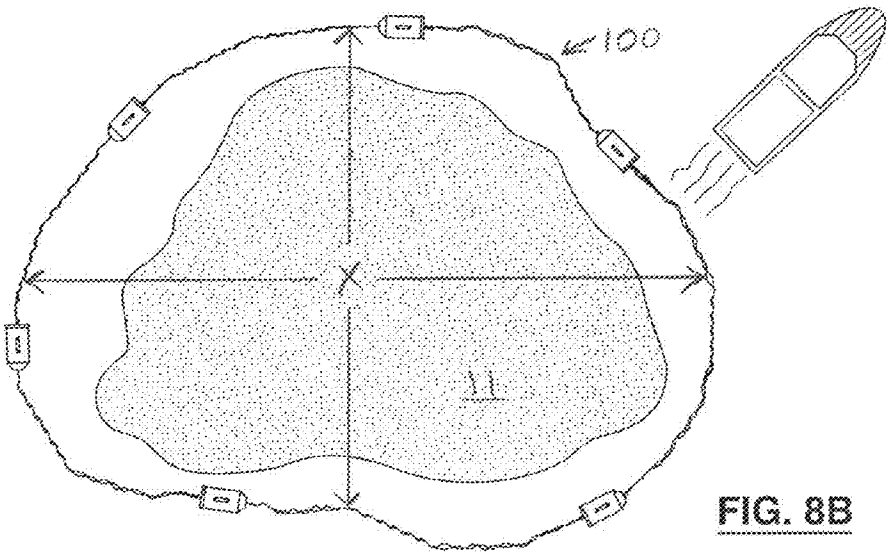
FIG. 8B is a top view of a distributed system of buoy assemblies of the invention positioned around an oil spill, drawn at a smaller scale.

FIG. 8B shows the system 100 positioned around the selected area X, for containment of the floating material 11. As can be seen in FIG. 8B, in one embodiment, the buoy assemblies are positioned around the floating material 11, spaced apart from the floating material by an approximate distance.

FIG. 3 is a top view of two buoy assemblies 10*c*, 10*d* connected in series, e.g., as the buoy assemblies 10*c*, 10*d* are distributed.

Figure 4:
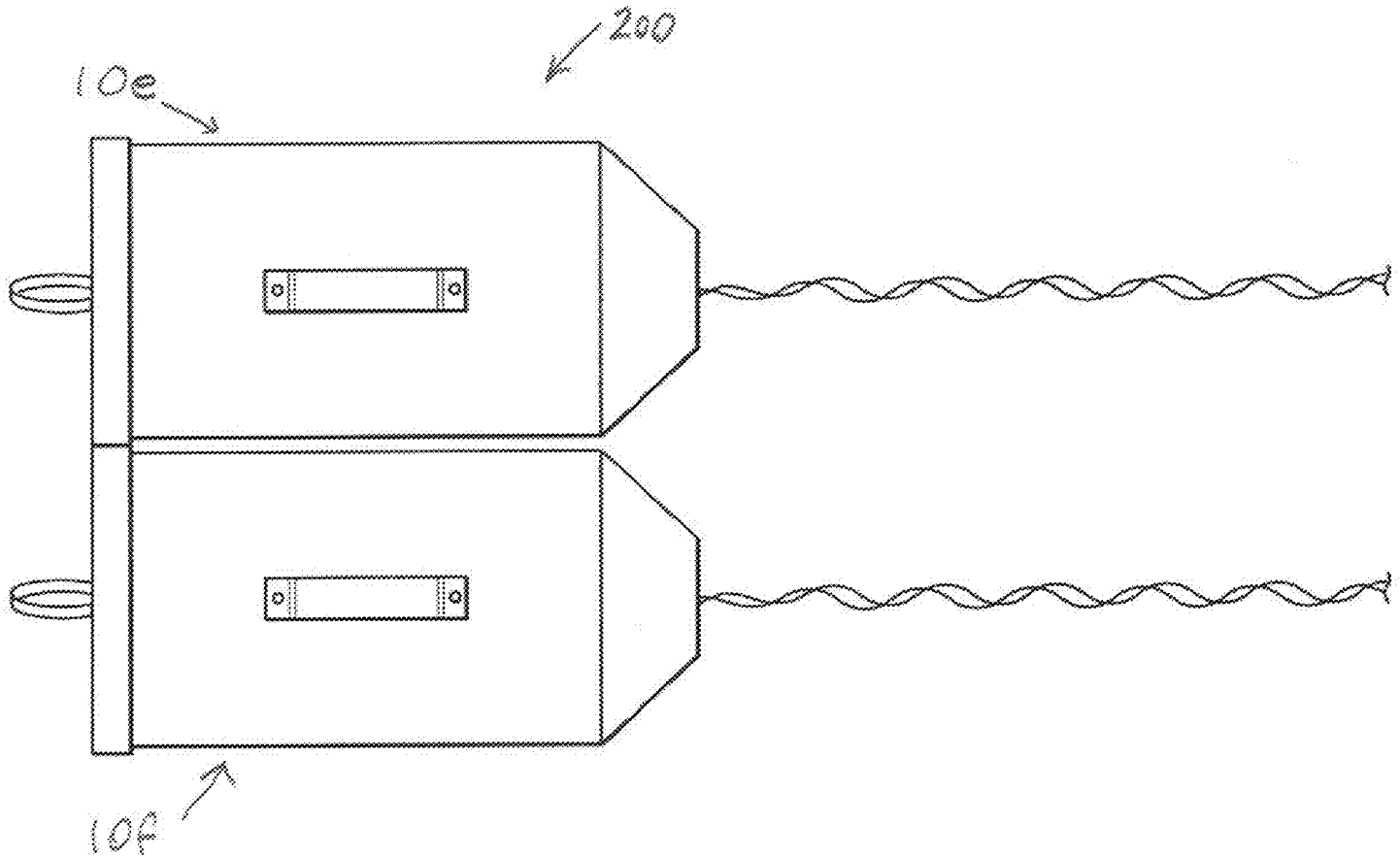
FIG. 4 is a top view of two buoy assemblies of FIG. 1A connected in parallel.

Alternatively, one or more buoy assemblies 10 connected in parallel may form the system 200 (FIG. 4). This arrangement may be used, for instance, where wave conditions are sufficiently bad that the parallel configuration is needed to achieve an acceptable degree of containment of the floating material. Preferably, the buoy assemblies (identified for convenience as 10*e*, 10*f* in FIG. 4) are attached to each other in parallel. The bodies of the buoy assemblies 10*e*, 10*f* may be attached to each other by any suitable means, e.g., the bodies may be strapped together. The buoy assemblies 10*e*, 10*f* preferably are connected to other buoy assemblies (not shown in FIG. 4) respectively in series.

Figure 5:
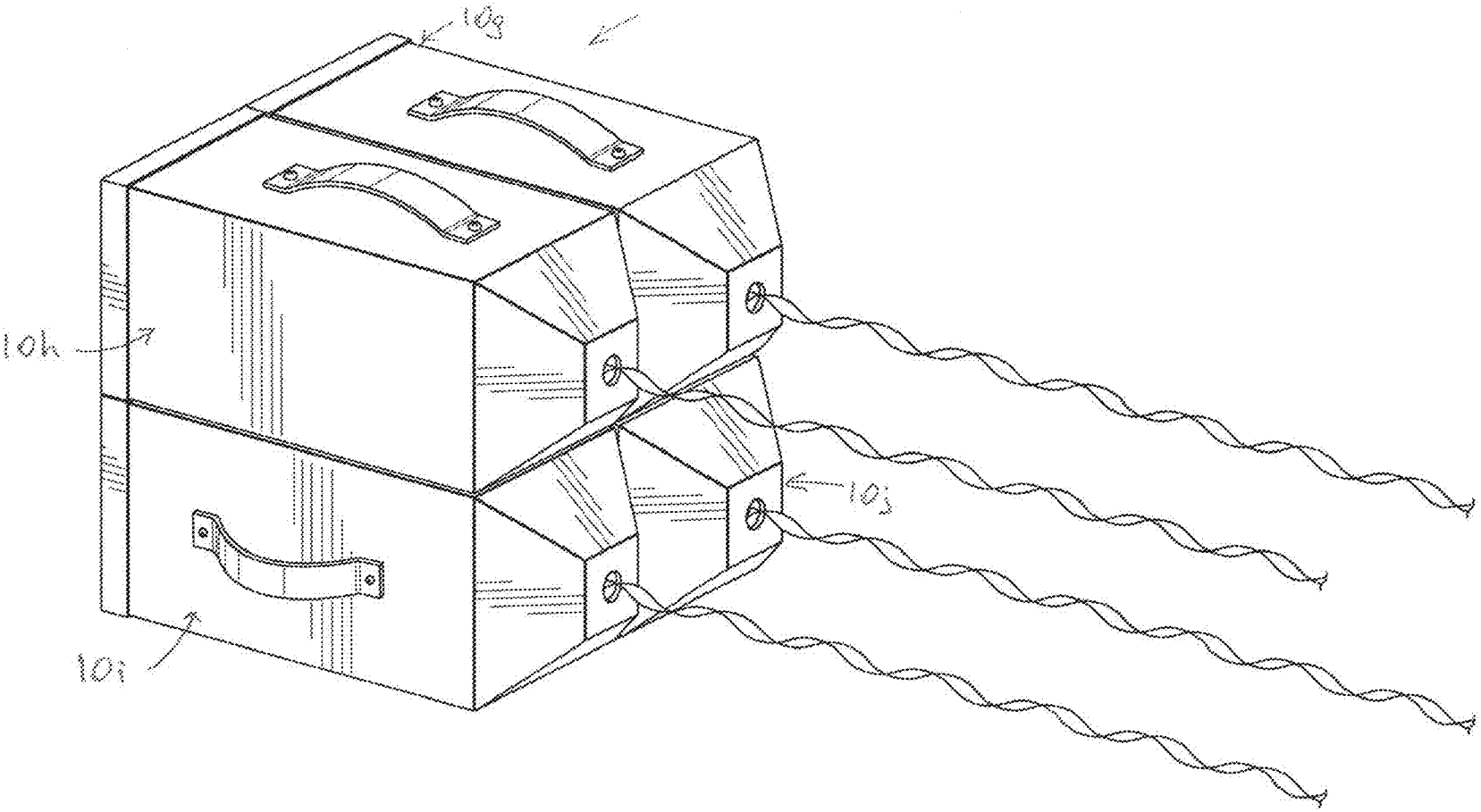
FIG. 5 is an isometric view of four buoy assemblies of FIG. 1A positioned in parallel.

Another system 300 is shown in FIG. 5. The bodies of the buoy assemblies 10*g*-10*j* preferably are attached to each other by any suitable means to provide improved containment of the floating material in poor weather and wave conditions. For example, the bodies of the buoy assemblies 10*g*-10*j* may be strapped together.

Figure 9A:
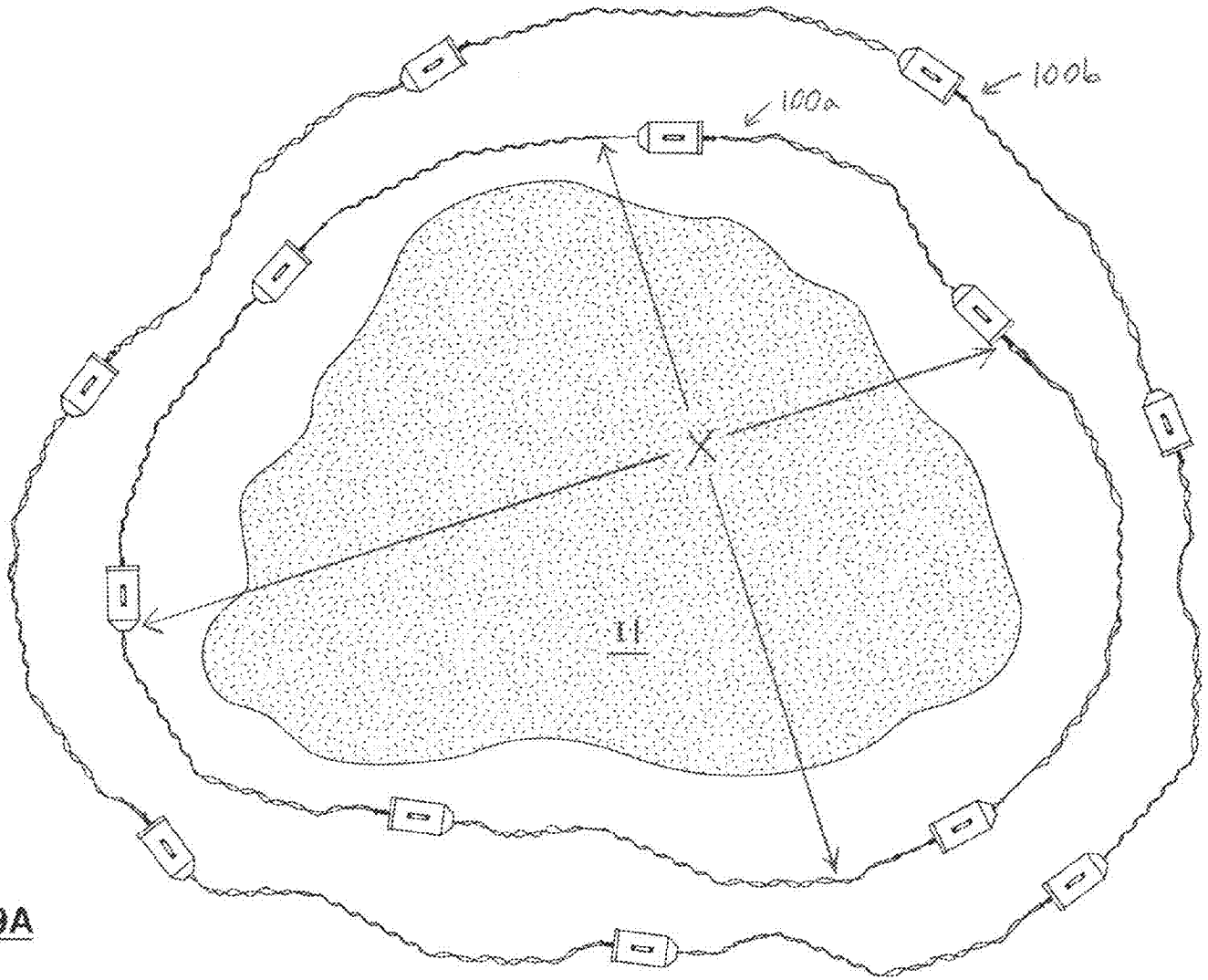
FIG. 9A is a top view of two distributed systems of buoy assemblies of the invention.
Figure 9B:
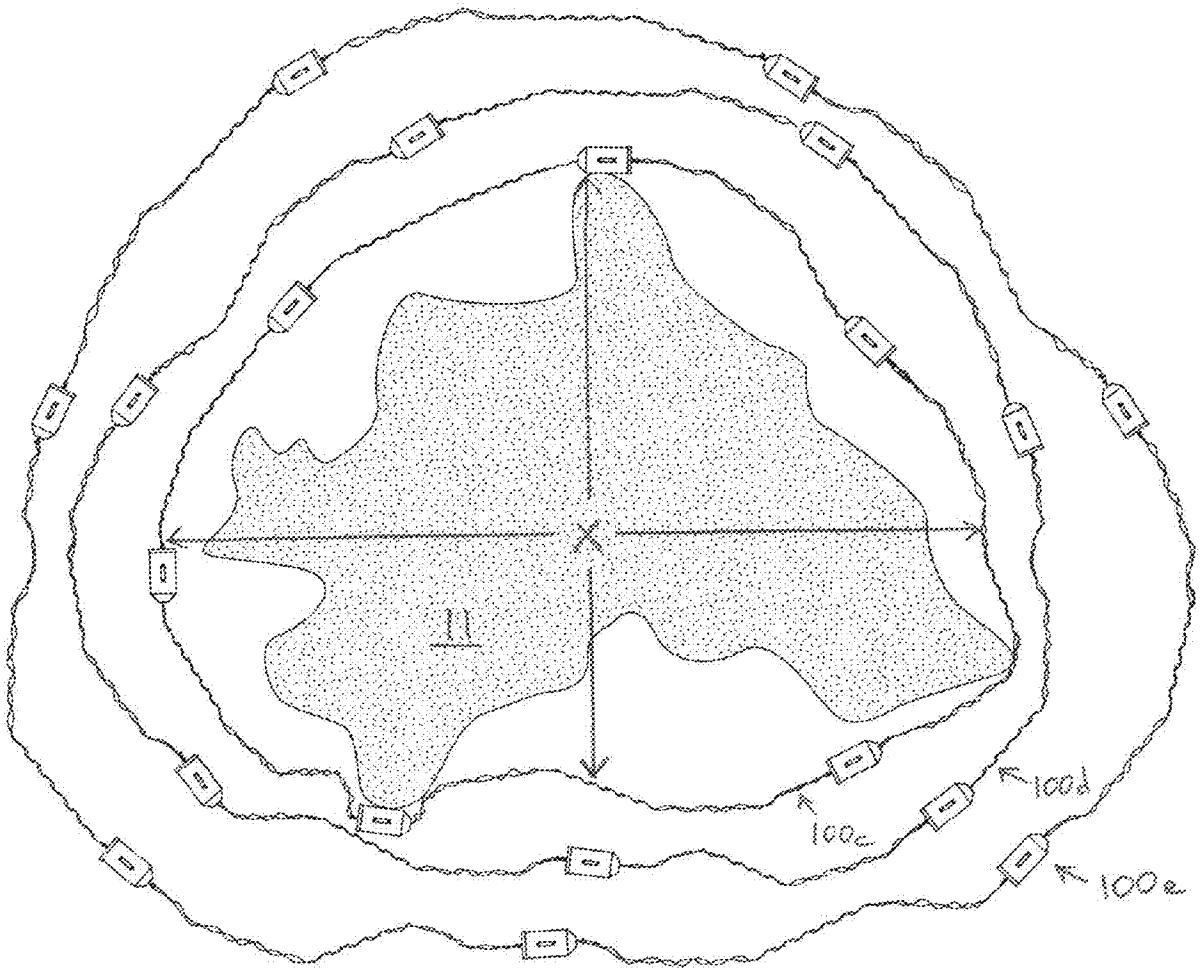
FIG. 9B is a top view of three distributed systems of buoy assemblies of the invention, drawn at a smaller scale.

FIG. 9A illustrates the distribution of two systems (designated 100*a* and 100*b* for convenience) in which buoy assemblies are connected in series, but the two systems 100*a*, 100*b* are distributed in parallel. Although any number of systems may be distributed around the preselected area X, it is preferred that at least two parallel systems are distributed, as shown in FIG. 9A. Distributing at least two systems around the selected area X has several advantages. In practice, as the floating material 11 (e.g., oil) begins to contact the system 100*a*, the system 100*a* tends to become black with oil. The oil-blackened system 100*a* is difficult to see in the water. The barrier material is preferably a bright colour such as lime green or orange. Distributing the additional system 100*b* which does not become discolored with oil allows responders to easily locate the spill from boat or an aircraft. The other advantage of distributing the second system is that containment of the floating material is likely to be better than if only one system is distributed. This may be important, for example, where wave conditions are such that containment by a single system is unlikely to be complete. Or it may be important if the floating material is proximal to a particularly environmentally-sensitive site. More than two systems may be concentrically positioned relative to the selected area X, if necessary or advisable in the circumstances.

As described above, the systems 100*a*, 100*b* can be distributed relatively quickly and at a low cost. Deploying several systems of buoy assemblies adds to the protection of the environment at a relatively low cost compared to prior art devices and methods.

Figure 7:
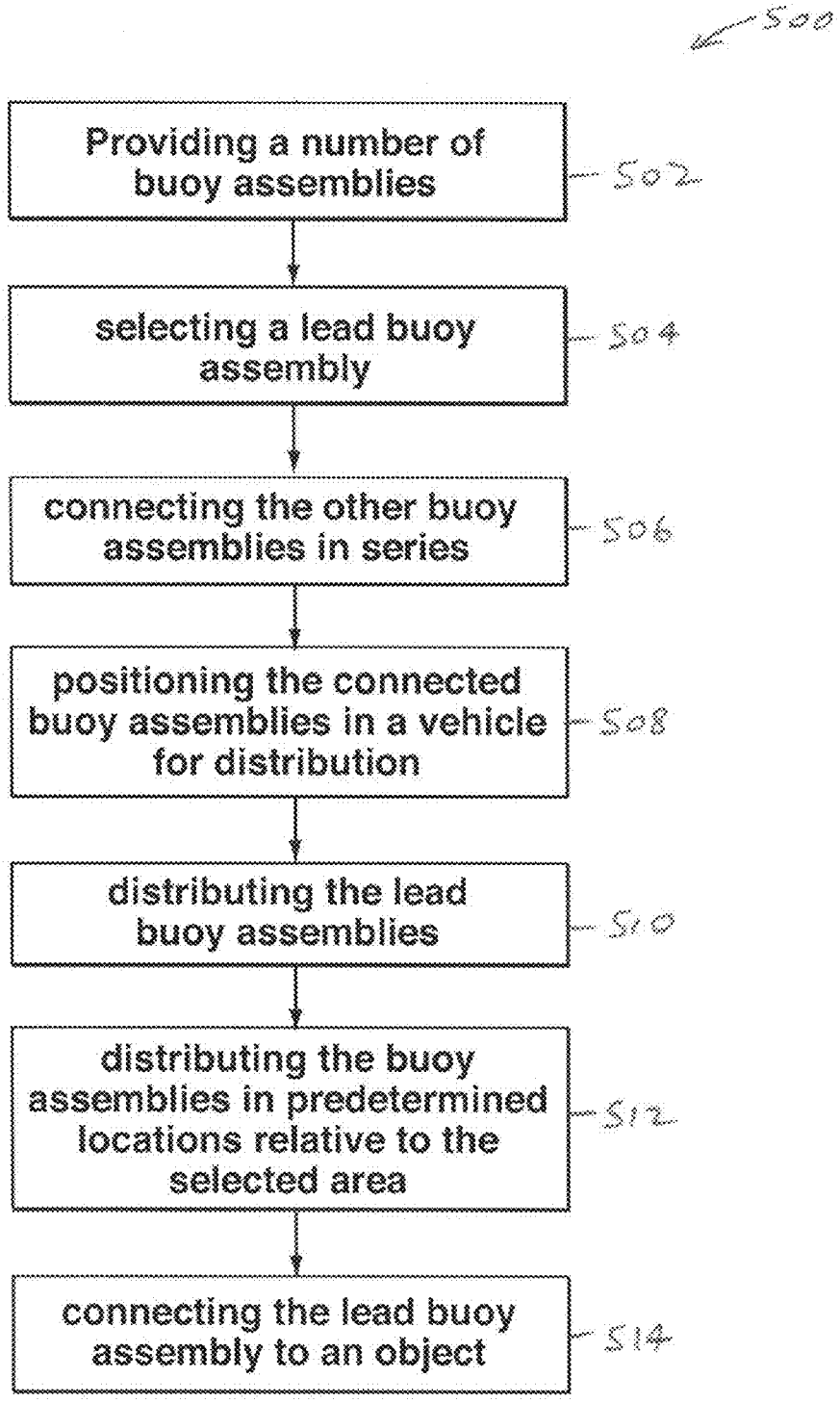
FIG. 7 is a block diagram schematically illustrating certain steps in an embodiment of a method of the invention.

In use, a method of the invention for deploying a plurality of buoy assemblies from the vehicle 84 is illustrated in FIGS. 7, 8A and 8B. The method 500 begins at step 502 (FIG. 7), in which the buoy assemblies are provided. Next, a lead buoy assembly is selected (step 504). This is the buoy assembly which will be positioned on the water surface first. Next, the other buoy assemblies are connected in series with the lead buoy assembly leading (step 506). Sufficient buoy assemblies are connected to provide sufficient deployed lengths to contain the floating material in the selected area X. Next, the connected buoy assemblies are positioned in the vehicle 85 for distribution therefrom (step 508), i.e., if a vehicle is to be used, and the vehicle 85 is then caused to move forward (i.e., in the direction indicated by arrow "D" in FIG. 8A). Next, the lead buoy assembly is distributed (step 510). This may be initiated by throwing the free end 21 of the lead buoy assembly into the water, with a selected length of deployed barrier material, e.g., between about 1.5 meters and about 3 meters of barrier material. Once such selected length is on the water, with the forward movement of the vehicle, the balance of the deployed length for the lead buoy assembly is pulled out of the body thereof, due to drag. Once all the deployed length of the lead buoy assembly has been deployed, then the body 12 is pulled out of the vehicle 85 and onto the water. Because the fastener element of the second buoy assembly is connected to the connecting element 68 of the lead buoy assembly, the movement of the body 12 of the lead buoy assembly onto the water in turn pulls the fastener element of the second buoy assembly onto the water, beginning the deployment of barrier material from the second buoy assembly. This process continues until all the buoy assemblies have been distributed. Accordingly, after the lead buoy assembly has been distributed (i.e., positioned in the predetermined location therefor on the water), the other buoy assemblies are distributed in the predetermined locations therefor (step 512).

The fastener element 58 at the free end of the lead buoy assembly preferably is connected to an object (step 514). Preferably, the fastener element 58 is adapted to float. In one embodiment, after the buoy assemblies are distributed, the fastener element 58 for the lead buoy assembly is picked up out of the water and then manually attached to the object. For example, in one embodiment, after the buoy assemblies are distributed, the fastener element 58 of the lead buoy assembly is attached to the connecting element 68 of the last of the other buoy assemblies.

It will be understood that less than the entire deployable part of the barrier material may be deployed. For example, in a system including buoy assemblies connected in series, it may be desired to deploy only a part of the deployable barrier material in the body in the last buoy assembly in the series. This may be done, for instance, due to only a relatively short distance remaining in a perimeter around the selected area X to be closed by the final buoy assembly.

It will be understood that the steps of the method 500 may be performed in another order. For example, the buoy assemblies may be positioned in the vehicle prior to connection.

In another embodiment, the methods of the present invention may be carried out by distributing the buoy assemblies from another moving vessel, such as an aircraft. To deploy from an aircraft, it is generally required to deploy a body 12 to begin as deploying a length of the barrier material 16 first may not be heavy enough for the barrier material 16 to overcome the airflow generated by the aircraft to fall to the water.

In yet another embodiment, the methods of the present invention may be carried out manually from a beachfront area, e.g., by people moving the buoy assemblies into position by carrying them into the water.

In one embodiment, the barrier material may be deployed across the surface of a water body by securing the free end of the barrier material 16 on land (for example, by wrapping the free end around a tree) and then propelling the body 12 across the water. For instance, the body 12 may be propelled by means of a "gun" device or harpoon. When the body 12 reaches the other side of the water body, the free end of the barrier material 16 is secured thereto, to protect the entire length of the water body from the floating material.

The buoy assemblies 10 may be retrieved from the water 42 by grabbing the handle 62 by hand or by using another device such as a hook on the end of a rod. Alternatively, the buoy assemblies 10 may be retrieved by pulling on the barrier material 16 until the body 12 is within reach. The buoy assemblies 10 are reusable (except for the barrier material 16), once the oil is properly disposed of in accordance with local regulations. The barrier material is replaced by installing a new roll of the barrier material which is provided by the manufacturer already pre-wound on a core 18, i.e., in a new roll subassembly 14.

Figure 6:
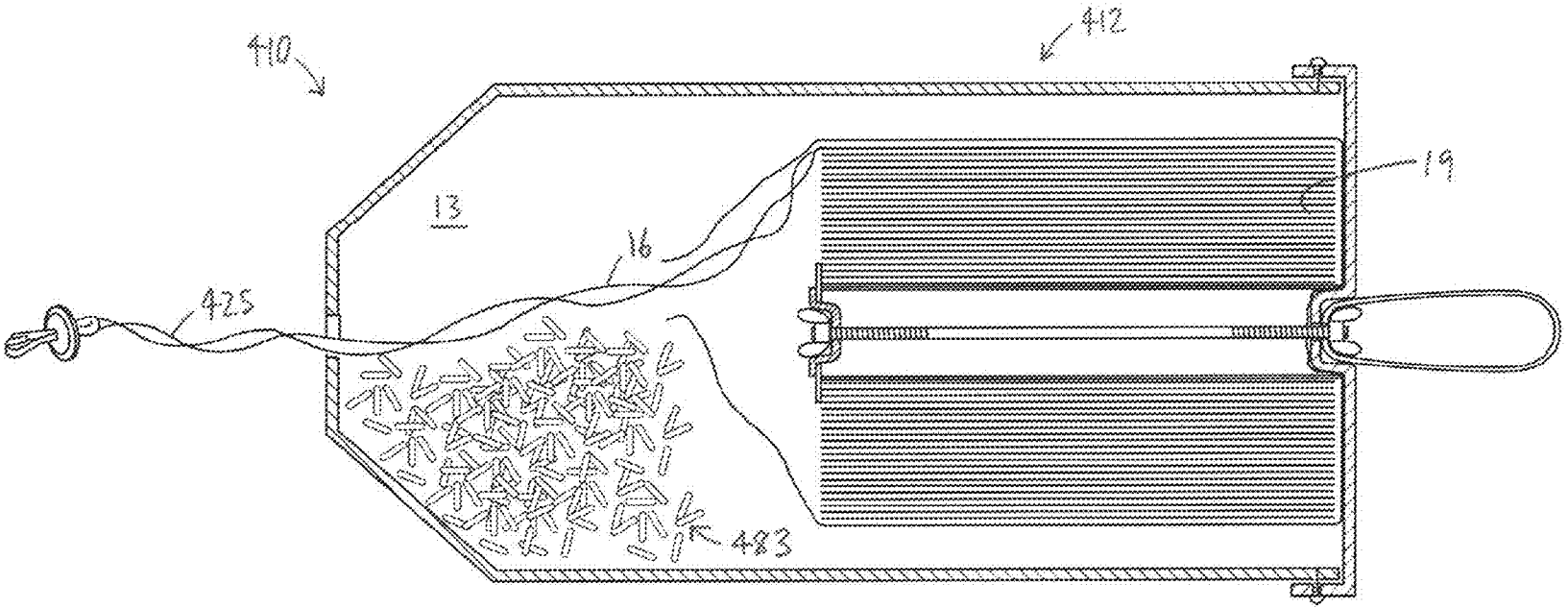
FIG. 6 is a longitudinal cross-section of another embodiment of the buoy assembly of the invention drawn at a larger scale.

Reference is next made to FIG. 6 in which another embodiment of the buoy assembly of the invention is illustrated. The buoy assembly 410 shown in FIG. 6 is similar to the buoy assembly 10 illustrated in FIG. 1C, however, the buoy assembly 410 also includes an agent 483 positioned in the cavity 13 of the body 412. The agent 483 is a substance that is active in the degradation of oil, such as oil decomposing bacterial cultures or enzymes or any other substances which promote the degradation of oil by bacteria already present in the water. Those skilled in the art would be aware of suitable agents. Accordingly, it is not necessary to describe the agent 483 in detail. The agent 483 may be provided in the form of a powder, liquid or gel.

As shown in FIG. 6, the agent 483 is positioned in the path of the barrier material 16 as the barrier material 16 is deployed from the concentric roll 19. As barrier material 16 is pulled from the concentric roll 19 through the agent 483, the agent 483 is attached to the barrier material 16. In this way, a deployed length 425 is at least partially coated with the oil-degrading agent 483. The agent 483 proceeds to degrade the oil on the water surface when the agent 483 comes into contact with the oil.

It will be appreciated that the buoy assembly 10 has several other uses in addition to controlling oil spills. For example, the buoy assembly 10 may be used as a marker for a sunken boat or snowmobile. The bright barrier material allows the sunken boat or snowmobile to be easily found for retrieval if desired. Furthermore, the buoy assembly 10 may be used as a "help" or SOS signal for stranded travellers. When 1000 feet of barrier material is deployed by such travellers, then searchers have a much greater chance of visually locating the travellers.

It will be appreciated by those skilled in the art that the invention can take many forms, and that such forms are within the scope of the invention as claimed. Therefore, the spirit and scope of the appended claims should not be limited to the descriptions of the preferred versions contained herein.

We claim:

1. A buoy assembly for at least partially containing a floating material on a surface of a body of water in a selected area thereon, the buoy assembly comprising:

a roll subassembly comprising a core element defined by a central axis thereof and a concentric roll of a predetermined length of a barrier material wrapped around the core element, the barrier material extending between a fixed end attached to the core element and a free end thereof;

a body defining a cavity therein, the body comprising a mounting subassembly for locating the roll subassembly in a predetermined position therein; and the body comprising an aperture through which a deployed length of the barrier material passes as the deployed length exits the body, the aperture being formed for twisting the deployed length into an at least partially helical configuration such that upon deployment of the deployed length on the water surface, the deployed length engages the water surface and extends above the water surface by a predetermined minimum distance for engaging the floating material.

2. A buoy assembly according to claim 1 in which, when the roll subassembly is in the predetermined position in the body, the aperture is coaxial with the core element.

3. A buoy assembly according to claim 2 in which the core element and the aperture are spaced apart from each other by a predetermined distance to permit the deployed length to be formed into the at least partially helical configuration as the deployed length passes through the aperture.

4. A buoy assembly according to claim 1 in which, after the body is located on the water surface in a floating position, the body sinks to a predetermined semi-submerged position during deployment of the deployed length.

5. A buoy assembly according to claim 4 in which the body sinks from the floating position to the semi-submerged position at a predetermined rate during deployment of the deployed length.

6. A buoy assembly according to claim 4 in which, when the body is in the semi-submerged position, the deployed length engages the water surface and extends above the water surface by the predetermined minimum distance for engagement with the floating material.

7. A buoy assembly according to claim 6 in which:

the body comprises a main portion extending between a front end at which the aperture is located and a back end thereof distal thereto, and an end portion releasably attachable to the back end of the main portion; and the main portion and the end portion define at least one opening therebetween when the end portion is attached to the main portion for allowing water to enter the cavity, said at least one opening being sized to permit the body to sink at the predetermined rate.

8. A buoy assembly according to claim 7 in which the predetermined rate is between a minimum rate, defined by a minimum time for the body to sink to the predetermined semi-submerged position, and a maximum rate, defined by a maximum time for the body to sink to the predetermined semi-submerged position.

9. A buoy assembly according to claim 7 in which the mounting subassembly comprises a mounting part disposed on the end portion, for locating the roll subassembly in the predetermined position inside the body.

10. A buoy assembly according to claim 1 in which the body is substantially level as it sinks from the floating position to the semi-submerged position.

11. A buoy assembly according to claim 1 in which the roll subassembly additionally comprises a fastener element attached to the free end of the barrier material.

12. A buoy assembly according to claim 11 in which the body comprises a connecting element adapted for releasable connection with the fastener element for fastening the free end to the body to position the deployed length in a preselected location relative to the selected area.

13. A buoy assembly according to claim 1 in which the mounting subassembly comprises a threaded rod attached to an inner side of the end portion of the body for securing the roll subassembly in the predetermined position.

14. A buoy assembly according to claim 1 in which the roll subassembly additionally comprises a bag portion for limiting contact of barrier material in the roll with water.

15. A system for at least partially containing a floating material on a surface of a body of water in a selected area thereon, the system comprising:

a plurality of buoy assemblies, each said buoy assembly comprising:

a roll subassembly comprising a core element defined by a central axis thereof and a concentric roll of a predetermined length of a barrier material wrapped around the core element, the barrier material extending between a fixed end attached to the core element and a free end thereof;

a body defining a cavity therein, the body comprising a mounting subassembly for locating the roll subassembly in a predetermined position therein;

the body comprising an aperture through which at least a deployed length of the barrier material passes as the deployed length exits the body, the aperture being formed for twisting the deployed length into an at least partially helical configuration as the deployed length passes therethrough such that upon deployment of the deployed length on the water surface, the deployed length engages the water surface and extends above the water surface by a predetermined minimum distance for engaging the floating material;

the roll subassembly comprising a fastener element attached to the free end; and the body comprising a connecting element adapted for connection with the fastener element for positioning the deployed length in a preselected location relative to the selected area.

16. A system according to claim 15 in which the buoy assemblies are connected in series.

17. A system according to claim 15 in which at least two of the buoy assemblies are connected in parallel.

18. A body adapted for deployment therefrom of a barrier material on a surface of water, the body comprising:

a main portion defining a cavity therein, the main portion extending between a front end and a back end thereof, and an end portion positioned at the back end of the main portion;

the body comprising a mounting subassembly for locating a roll of the barrier material in a predetermined position inside the body;

the body comprising an aperture through which a deployed length of the barrier material passes as the deployed length exits the body, the aperture being formed for twisting the deployed length into an at least partially helical configuration as the deployed length passes therethrough; and the end portion being adapted for removal from the main portion to permit locating the roll in the cavity.

19. A method for at least partially containing a floating material on the surface of water in a selected area thereon, the method comprising the steps of:

(a) providing a plurality of buoy assemblies, each said buoy assembly comprising:

a roll subassembly comprising a core element defined by a central axis thereof and a concentric roll of a predetermined length of the barrier material wrapped around the core element, the barrier material extending between a fixed end attached to the core element and a free end thereof;

a body defining a cavity therein, the body comprising a mounting subassembly for locating the roll subassembly in a predetermined position therein; and the body comprising an aperture through which at least a deployed length portion of the barrier material passes as the deployed length exits the body, the aperture being formed for twisting the deployed length into an at least partially helical configuration as the deployed length passes therethrough such that upon deployment of the deployed length on the water surface, the deployed length engages the water surface and extends above the water surface by a predetermined minimum distance;

(b) selecting a lead buoy assembly;

(c) connecting the other buoy assemblies to each other in series with the lead buoy assembly leading, to provide sufficient deployed lengths to contain the floating material in the selected area;

(d) positioning the connected buoy assemblies in a vehicle for distribution therefrom;

(e) causing the vehicle to move relative to the water;

(f) distributing the lead buoy assembly on the water surface; and (g) distributing the other buoy assemblies following the lead buoy assembly in preselected locations relative to the selected area as the vehicle moves relative to the water.

20. A method according to claim 19 comprising:

(g) connecting the lead buoy assembly to an object.

21. A method according to claim 19 comprising:

(g) connecting the lead buoy assembly to a final one of the other buoy assemblies.

* * * * *